US011840413B2

(12) United States Patent
Kakui et al.

(10) Patent No.: US 11,840,413 B2
(45) Date of Patent: Dec. 12, 2023

(54) ROLL PRINTER HOLDER

(71) Applicant: SATO HOLDINGS KABUSHIKI KAISHA, Tokyo (JP)

(72) Inventors: Yasuyuki Kakui, Tokyo (JP); Yoshihiro Tano, Tokyo (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 385 days.

(21) Appl. No.: 16/331,697

(22) PCT Filed: Aug. 28, 2017

(86) PCT No.: PCT/JP2017/030691

§ 371 (c)(1),
(2) Date: Mar. 8, 2019

(87) PCT Pub. No.: WO2018/168003

PCT Pub. Date: Sep. 20, 2018

(65) Prior Publication Data

US 2019/0202650 A1 Jul. 4, 2019

(30) Foreign Application Priority Data

Mar. 17, 2017 (JP) ..... 2017-052324

(51) Int. Cl.
*B65H 16/06* (2006.01)
*B41J 15/04* (2006.01)
*B65H 19/12* (2006.01)

(52) U.S. Cl.
CPC ..... *B65H 16/06* (2013.01); *B41J 15/042* (2013.01); *B65H 19/126* (2013.01); *B65H 2301/41346* (2013.01)

(58) Field of Classification Search
CPC ..... B65H 16/06; B65H 19/126; B65H 2301/41346; B65H 18/028; B65H 54/553;
(Continued)

(56) References Cited

U.S. PATENT DOCUMENTS

2011/0215189 A1 9/2011 Asai

FOREIGN PATENT DOCUMENTS

JP 2009- 34892 A 2/2009
JP 2009-120388 A 6/2009
(Continued)

*Primary Examiner* — Jennifer Bahls
*Assistant Examiner* — Quang X Nguyen
(74) *Attorney, Agent, or Firm* — Foley & Lardner LLP

(57) ABSTRACT

A printer includes: a container configured to contain a roll into which a belt-shaped print medium is wound, the roll being inserted through an opening; a guide configured to guide the roll, the guide being disposed in the container and having a pair of abutting faces that abut on both side faces of the roll; a holding part that is movable between a first position where the holding part protrudes inwardly from the abutting face and a second position where the holding part does not protrude inwardly from the abutting face, the holding part being biased from the second position to the first position and holding the roll rotatably at the first position; and a displacement part configured to be displaced with motion of the holding part. At least a portion of the displacement part is exposed when a user sees the displacement part through the opening, such that the displacement part is recognizably displaced in a different position depending on whether the holding part is at the first position or at the second position.

17 Claims, 11 Drawing Sheets

(58) Field of Classification Search
CPC ... B65H 2301/36112; B65H 2301/4134; B41J 15/042; B41J 15/046
See application file for complete search history.

(56) References Cited

FOREIGN PATENT DOCUMENTS

| | | | | | |
|---|---|---|---|---|---|
| JP | 2011148639 | A * | 8/2011 | ..... | B65H 16/06 |
| JP | 2011-201705 | A | 10/2011 | | |
| JP | 2016-124205 | A | 7/2016 | | |
| WO | WO-2012098891 | A1 * | 7/2012 | ..... | B41J 15/04 |

* cited by examiner

ROLL PRINTER HOLDER

TECHNICAL FIELD

The present invention relates to printers configured to hold a roll into which a belt-shaped print medium is wound.

BACKGROUND ART

Conventionally, a printer configured to contain and hold a roll, such as a paper roll into which a print paper is wound, has been known. For instance, the printer described in Patent Literature 1 includes a pair of supporting members to insert a roll (a roll body), a pair of pivots corresponding to the pair of supporting members, a pair of swing members that are attached to the pivots swingably, locking pins, and a biasing member to bias the swing members so as to move toward each other. In the printer described in Patent Literature 1, when the roll is inserted, the swing members swing due to the downward movement of the roll against the biasing force of the biasing member. This brings the locking pins located closer to the upper ends of the swing members into contact with the upper ends of the inner peripheral face of the roll, and the roll is held so as to hang from the locking pin.

CITATION LIST

Patent Literature

Patent Literature 1: Japanese Patent Application Laid-open 2009-34892 A

SUMMARY OF THE INVENTION

Problems to be Solved by the Invention

Such a conventional printer is configured to hold a roll by holding the inner tube of the roll, such as a paper tube, and a user cannot visually recognize the inner tube of the roll from the outside. This makes it impossible for the user to perceive whether the printer has reliably held or not during loading of the roll in the printer.

Then the present invention aims to provide a printer allowing a user to recognize whether the printer has reliably held the roll or not during loading of the roll in the printer.

Means for Solving the Problems

An embodiment of the present invention is a printer, including:

- a container configured to contain a roll into which a belt-shaped print medium is wound, the roll being inserted through an opening;
- a guide configured to guide the roll, the guide being disposed in the container and having a pair of abutting faces that abut on both side faces of the roll;
- a holding part that is movable between a first position where the holding part protrudes inwardly from the abutting face and a second position where the holding part does not protrude inwardly from the abutting face, the holding part being biased from the second position to the first position and holding the roll rotatably at the first position; and
- a displacement part configured to be displaced with motion of the holding part, wherein at least a portion of the displacement part is exposed through the opening, such that the displacement part is recognizably displaced in a different position depending on whether the holding part is at the first position or at the second position.

DETAILED DESCRIPTION OF THE INVENTION

The following describes one embodiment of a printer according to the present invention.

(1) Structure of Printer

Figure 1:
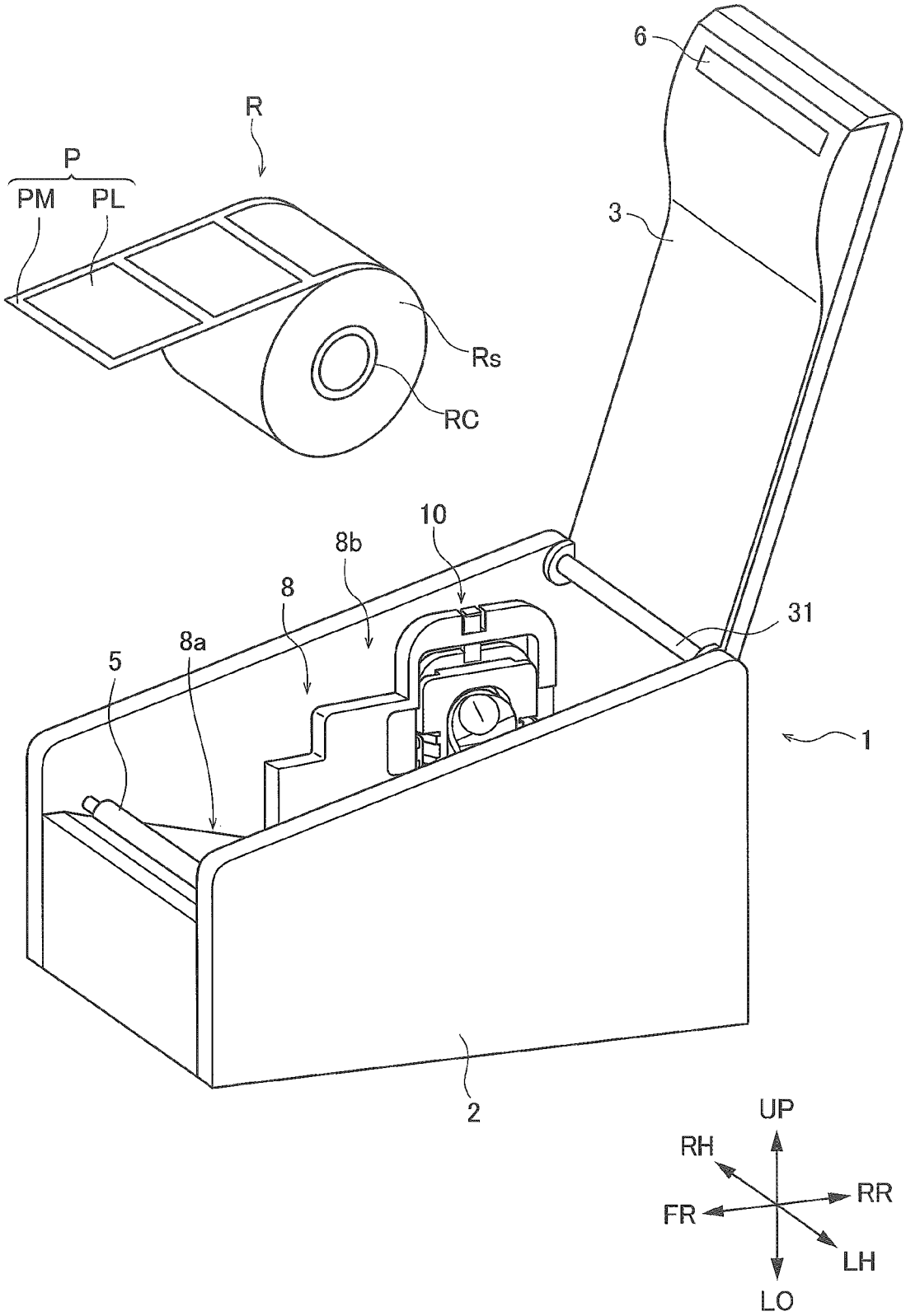
FIG. 1 is a perspective view of a printer according to one embodiment when the cover is open.
Figure 2:
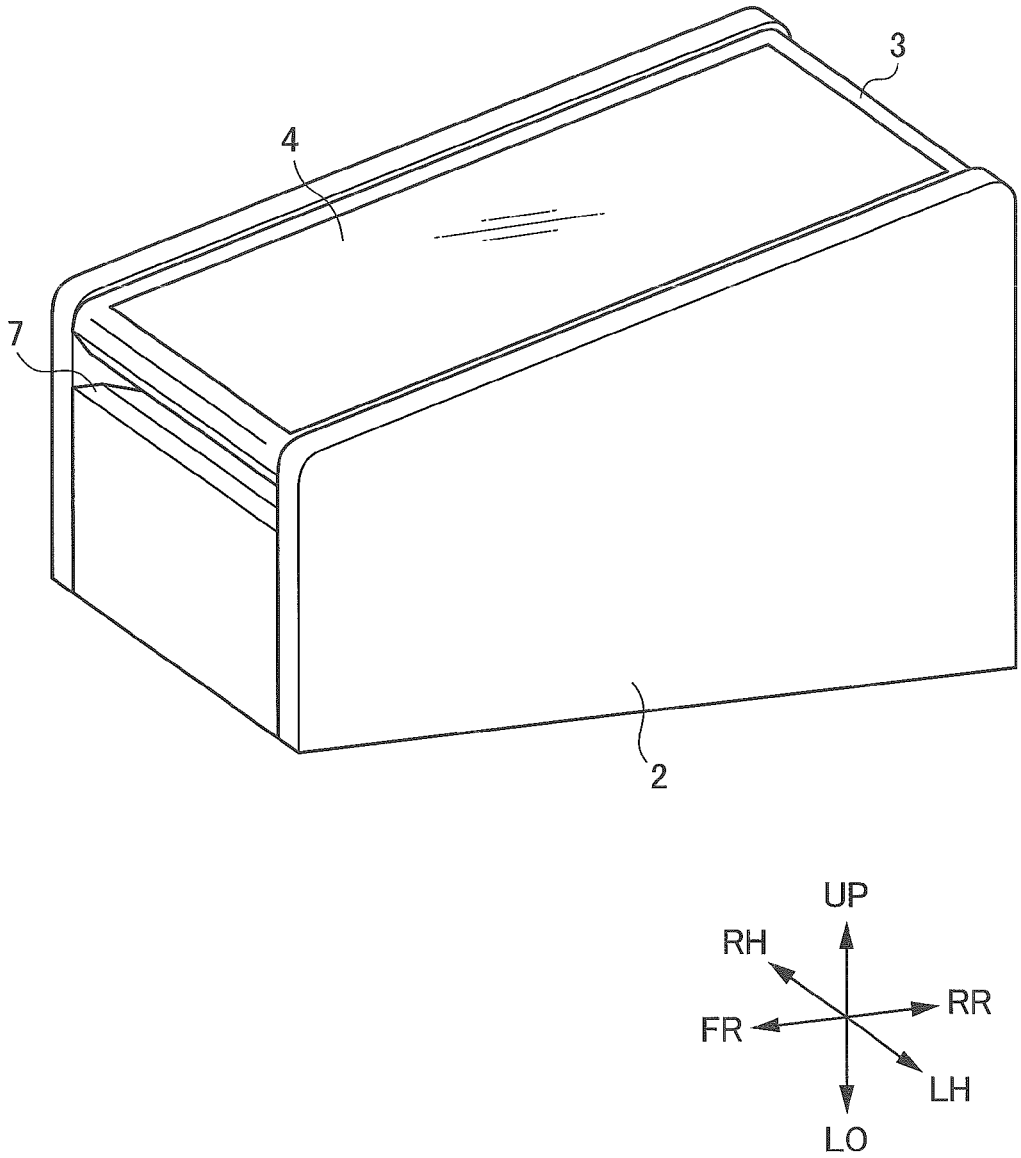
FIG. 2 is a perspective view of a printer according to one embodiment when the cover is closed.

Referring to FIGS. 1 and 2, the following describes a printer according to one embodiment.

FIG. 1 is a perspective view of a printer 1 according to the present embodiment when a cover 3 is open. FIG. 2 is a perspective view of the printer 1 according to the present embodiment when a cover 3 is closed.

As shown in FIGS. 1 and 2, the printer 1 of the present embodiment includes a housing 2, the cover 3, a display panel 4, a platen roller 5, a thermal head 6, and a container 8. The housing 2 is shaped to match with the outer shape of the printer 1.

In FIG. 1, the printer 1 has a substantially rectangular bottom face, and the direction along the long side of the bottom face is defined as the front-rear direction. Specifically, the side of the printer having the platen roller 5 placed downstream in the feeding direction is defined as the front (FR), and the side of the printer on the opposite side and upstream in the feeding direction is defined as the rear (RR). Then the right (RH), the left (LH), the upper (UP) and the lower (LO) are defined relative to the front-rear direction. In the following description, the right (RH) or the left (LH)

direction may be called a transverse direction and the upper (UP) or the lower (LO) direction may be called a vertical direction as needed.

The container 8 is an internal space of the housing 2 to contain a paper roll R. The container 8 is defined with an inner bottom face 8*a* at the bottom, the inner face of the cover 3 at the top, and the inner side faces of the housing on the left and right. The cover 3 is provided to open or close the container 8. The cover 3 is supported swingably at the rear end of the housing 2 via a shaft 31. When the container 8 is open, an opening 8*b* is defined so as to be opposed to the inner bottom face 8*a* of the container 8.

A paper roll R is a roll into which a belt-shaped continuous sheet P (one example of a print medium) is wound around a paper core RC, and the paper roll is one example of a roll. In the illustrated example, the continuous sheet P includes a belt-shaped liner PM and a plurality of labels PL. These labels are temporally attached to the liner at predetermined intervals. The paper roll R is inserted into the container 8 through the opening 8*b*.

In the following description, an "insertion direction" of the paper roll R refers to downward or obliquely downward that is oblique slightly backward from the downward, for example.

The printer 1 of the present embodiment extracts a continuous sheet P from the paper roll R while rotating the platen roller 5, and the container 8 includes a space to define the feed path of the extracted continuous sheet P from the paper roll to the platen roller 5.

A roll holding mechanism 10 is provided in the container 8. The roll holding mechanism 10 holds the paper roll R rotatably in the container 8 and limits the movement of the paper roll R in the width direction. The roll holding mechanism 10 of the present embodiment incorporates a motion mechanism (described later) so as to adapt to a variety of rolls of paper R having different widths.

As shown in FIG. 1, the platen roller 5 is supported rotatably in the forward and reverse directions at a downstream part of the housing 2 in the feeding direction. The platen roller 5 is a feeding means to feed the continuous sheet P extracted from the paper roll R. The platen roller extends in the width direction of the continuous sheet P. The platen roller 5 is mechanically coupled to and driven by a stepping motor (not illustrated) or the like.

As shown in FIG. 2, the display panel 4 is placed on the front surface side of the cover 3. The display panel 4 provides an input/output interface to a user when the cover 3 is closed. The display panel is a liquid crystal panel having a touch-panel function, for example.

The thermal head 6 is a print means to print information, such as letters, symbols, graphics or barcodes, on a label PL of the continuous sheet P extracted from the paper roll R. Although not shown in FIG. 2, when the cover 3 is closed, the print face of the thermal head 6 faces the sheet-feeding path of the continuous sheet P and the thermal head 6 is opposed to the platen roller 5. On the print face of the thermal head 6, a plurality of heater resistors (heater elements) that generate heat when applying current are arranged along the width direction of the continuous sheet P. The thermal head 6 is connected to a circuit board (not illustrated) configured to transmit a print signal to the thermal head 6. After printing on the continuous sheet P by the thermal head 6, the printer ejects the continuous sheet P to the outside of the printer 1 through an ejection port 7 (see FIG. 2), which is a gap defined between the housing 2 and the cover 3 when the cover 3 is closed.

Although not illustrated, a coil spring as a biasing member is located on the rear face of the thermal head 6. This coil spring gives a biasing force to the thermal head 6.

When the cover 3 is closed for printing, the continuous sheet P extracted from the paper roll R is fed by the platen roller 5 while being sandwiched between the platen roller 5 and the thermal head 6. At this time, the thermal head 6 is pressed against the platen roller 5 by the biasing force, whereby pressure from the head suitable for printing can be generated.

(2) Structure of Roll Holding Mechanism 10

Referring next to FIGS. 3 to 8, the following describes the structure of the roll holding mechanism 10.

Figure 3:
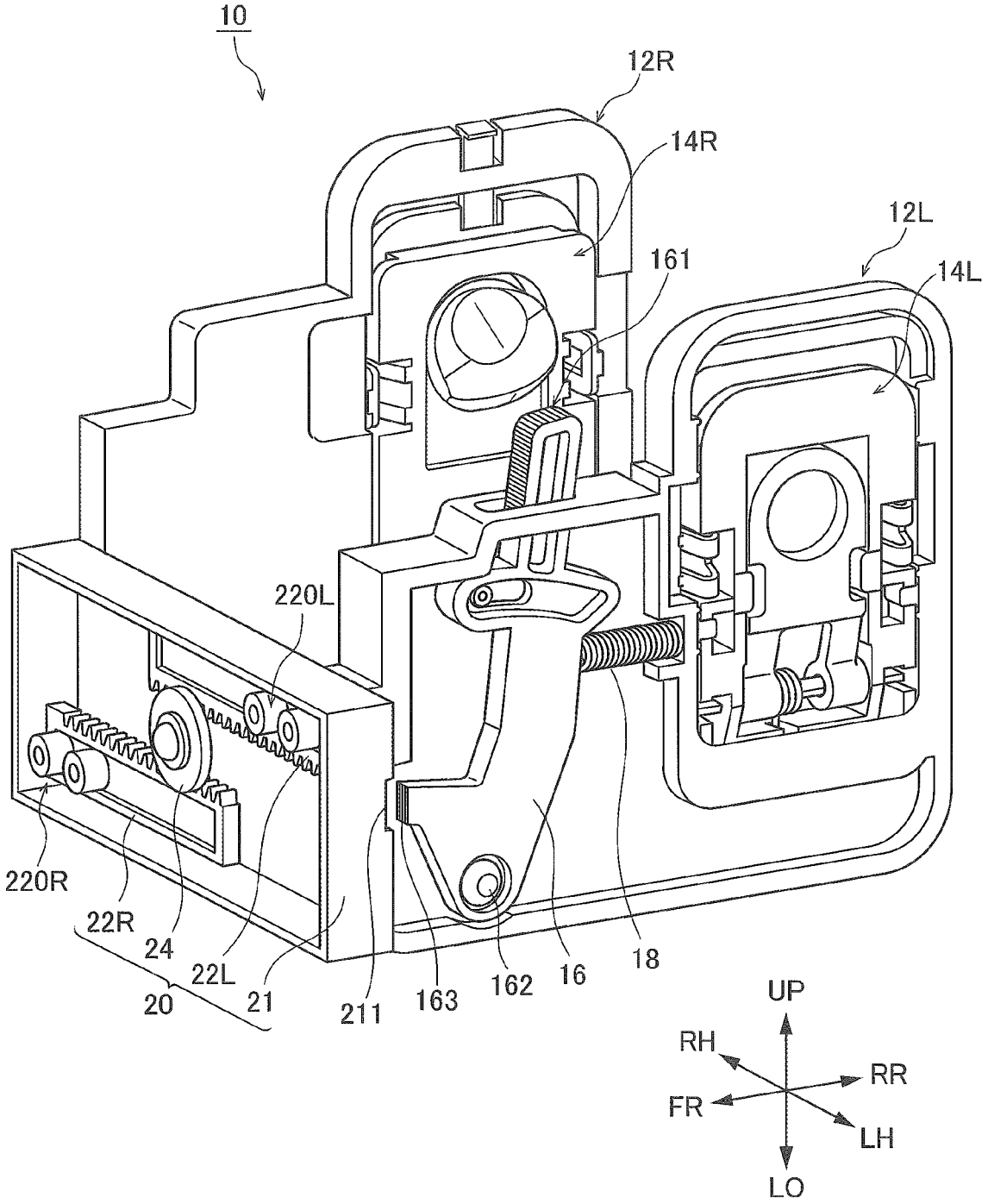
FIG. 3 is a perspective view of a roll holding mechanism according to one embodiment.

FIG. 3 is a perspective view of the roll holding mechanism 10 according to the present embodiment.

Figures 4A, 4B:
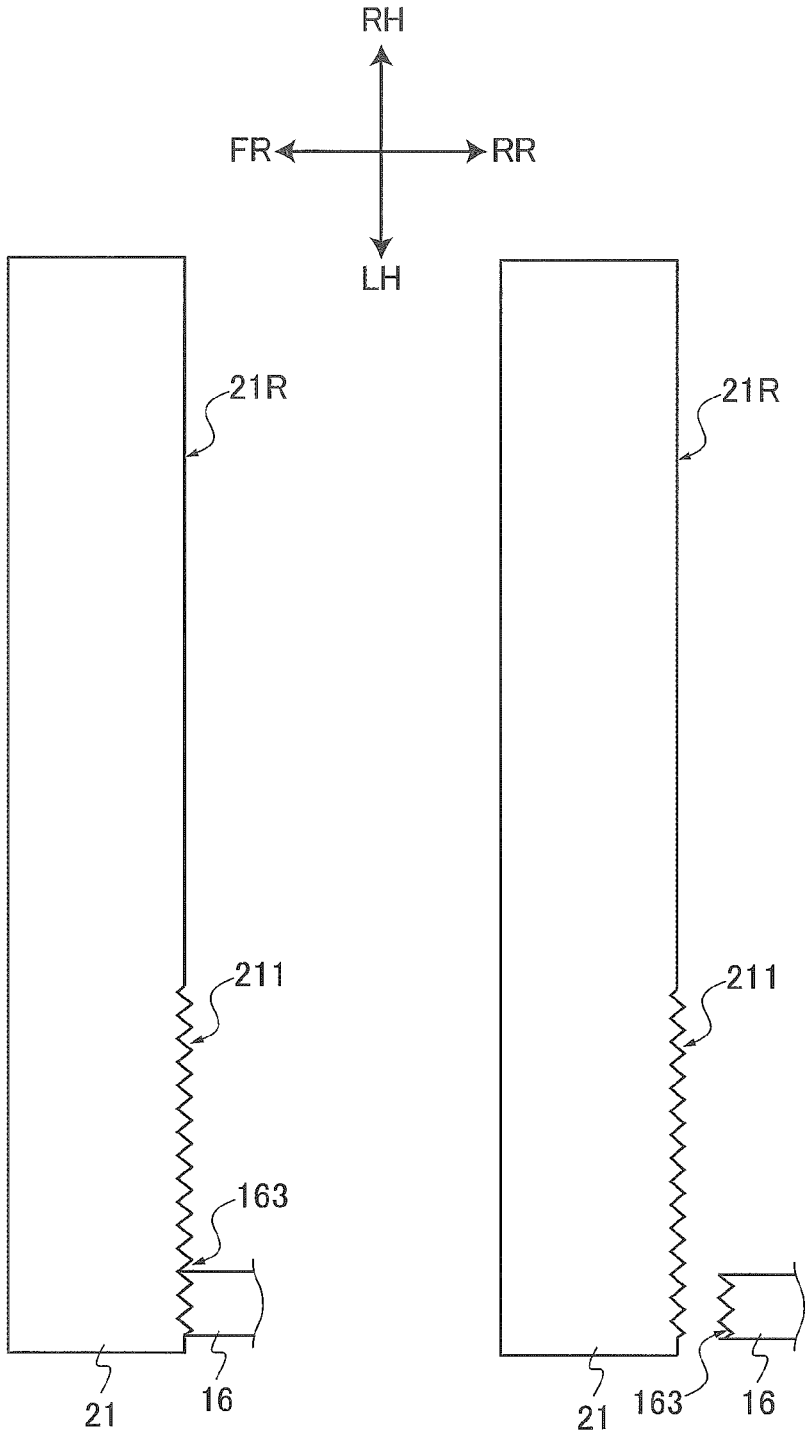
FIG. 4A is a plan view showing the housing of a motion mechanism according to one embodiment engaging with the lock member.
FIG. 4B is a plan view showing the housing of the motion mechanism not engaging with the lock member.

FIG. 4A is a plan view of the motion mechanism 20 of the roll holding mechanism 10 according to the present embodiment, showing the housing of the motion mechanism engaging with a lock member. FIG. 4B is a plan view of the motion mechanism 20 of the roll holding mechanism 10 according to the present embodiment, showing the housing of the motion mechanism not engaging with a lock member.

Figure 5:
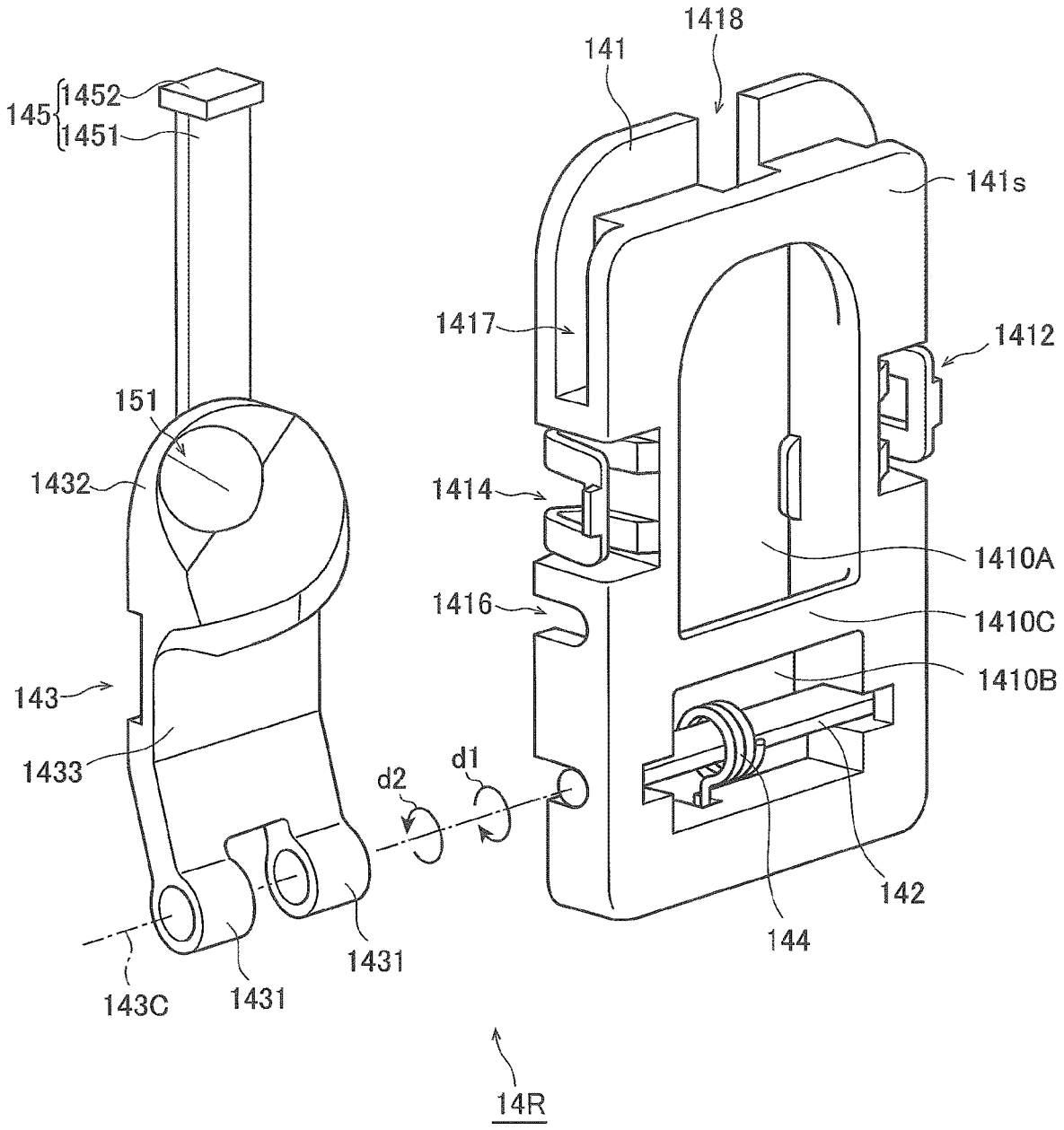
FIG. 5 is an exploded perspective view of a roll holder of the roll holding mechanism according to one embodiment.
Figure 6:
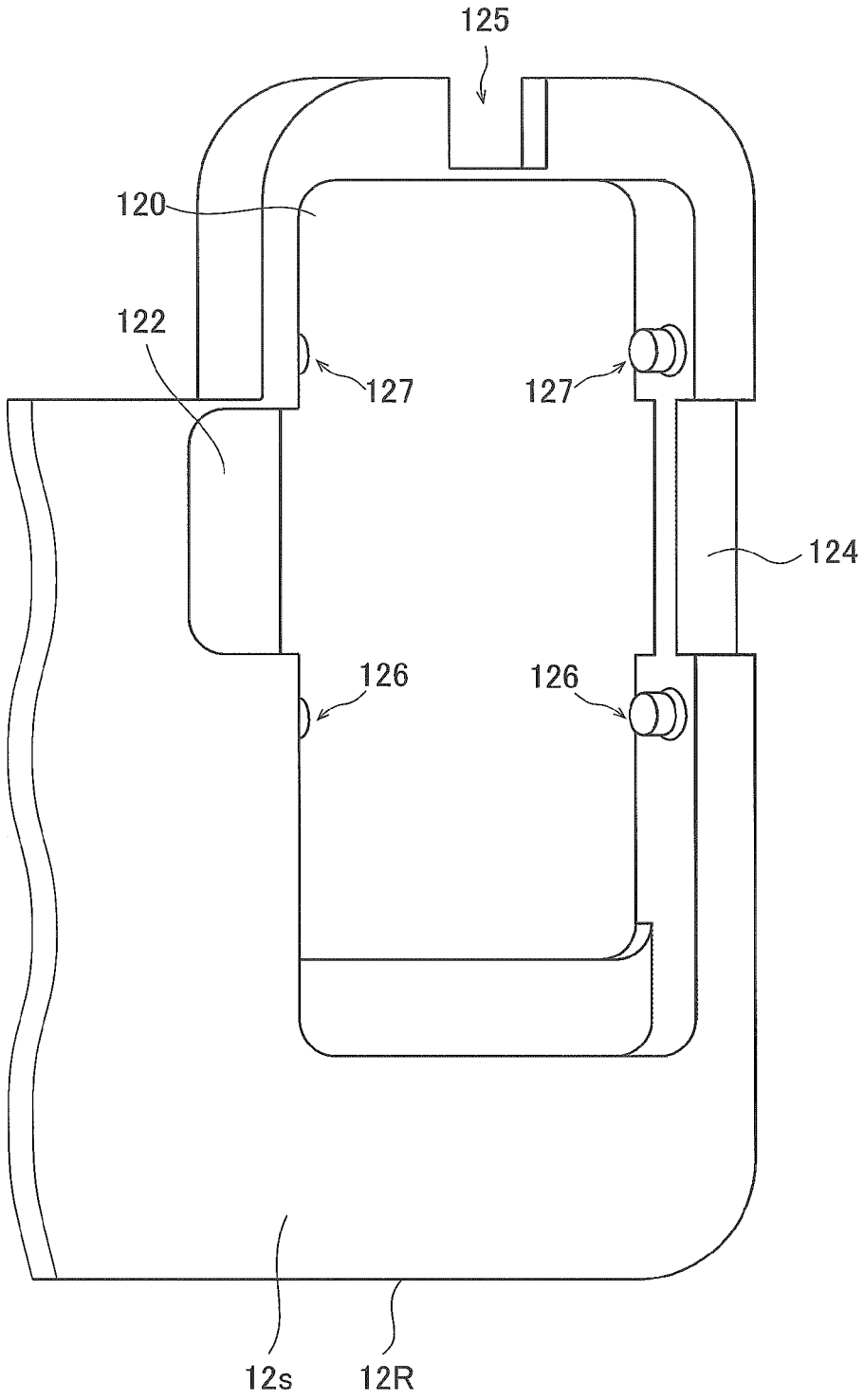
FIG. 6 is a partial perspective view of a guide of the roll holding mechanism according to one embodiment.
Figure 7:
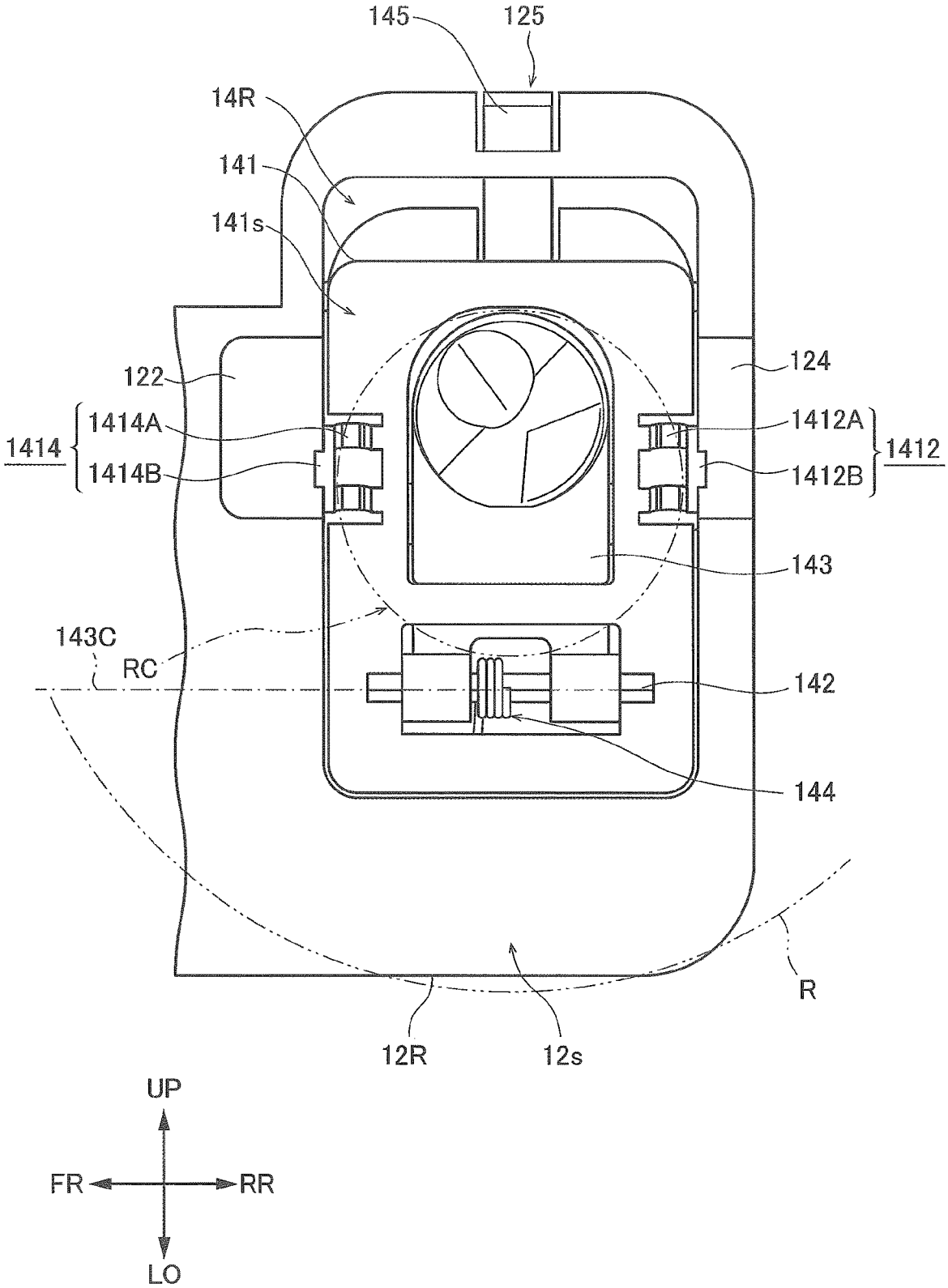
FIG. 7 is a side view of a part of the roll holding mechanism according to one embodiment viewed from one side.
Figure 8:
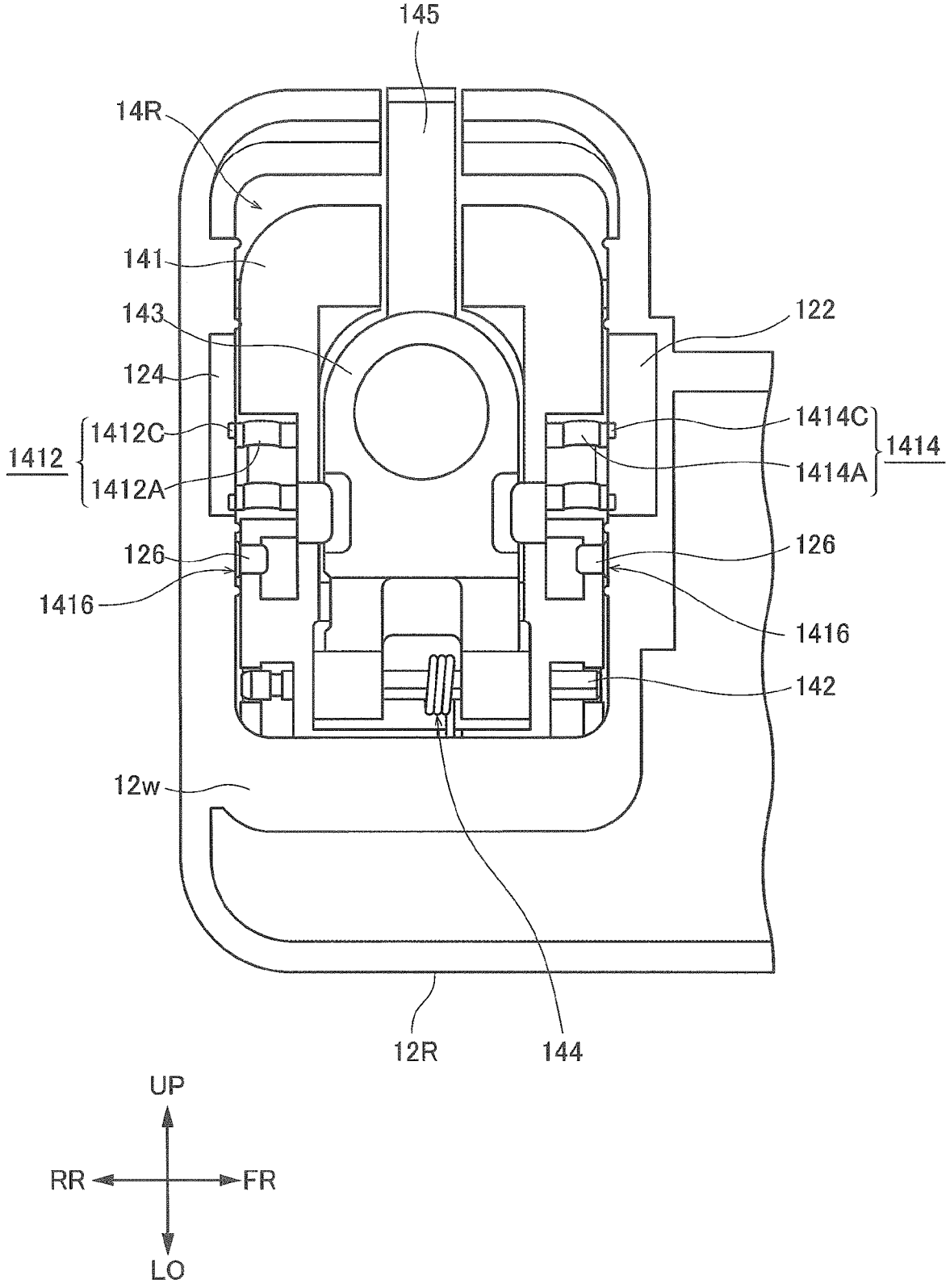
FIG. 8 is a side view of a part of the roll holding mechanism according to one embodiment viewed from the other side.

FIG. 5 is an exploded perspective view of a roll holder of the roll holding mechanism 10 according to the present embodiment. FIG. 6 is a partial perspective view of a guide of the roll holding mechanism 10 according to the present embodiment. FIG. 7 is a side view of a part of the roll holding mechanism 10 according to the present embodiment viewed from one side. FIG. 8 is a side view of a part of the roll holding mechanism 10 according to the present embodiment viewed from the other side.

Referring to FIG. 3, the roll holding mechanism 10 includes guides 12L, 12R and roll holders 14L, 14R. As described later, the roll holders 14L and 14R engage with the guides 12L and 12R, respectively.

The guides 12L, 12R are plate-shaped members extending in the front-rear direction of the printer 1. Each of the guides has an abutting face 12*s* (see FIG. 7) to abut on the side face Rs of the paper roll R. The guides limit the movement of the paper roll R in the width direction. The position of the roll holders 14L, 14R relative to the guides 12L, 12R can be changed.

The roll holding mechanism 10 of the present embodiment incorporates the motion mechanism 20. The motion mechanism allows the guides 12L and 12R to move toward each other or move away from each other (i.e., in the transverse direction or in the width direction of the paper roll R contained in the container 8). In other words, the motion mechanism 20 can adjust the positions of the guides 12L, 12R in the transverse direction in accordance with the width of the paper roll R.

The motion mechanism 20 includes a housing 21 and a pair of racks 22L, 22R and a pinion 24 in the housing. The guide 12L and the rack 22L are coupled via a fastener 220L from the rear face of the housing 21 so that these guide and rack can move together in the transverse direction. The guide 12R and the rack 22R are coupled via a fastener 220R from the rear face of the housing 21 so that these guide and rack can move together in the transverse direction.

The lock member 16 is a member to limit the motion of the guides 12L, 12R (i.e., lock the guides 12L, 12R) in the transverse direction or to cancel the limiting in response to the user's manipulation. The lock member 16 includes a tab 161 to be manipulated by a user, a shaft 162 and an engagement part 163 to engage with the rear face of the housing 21. The lock member 16 is mounted on the guide 12L at the shaft 162 so as to be swingable about the shaft 162.

FIG. 3 shows a state in which the guides 12L, 12R are not limited in the movement in the transverse direction.

FIG. 4A shows the housing 21 of the motion mechanism 20 engaging with the lock member 16. In the example of FIG. 4A, the engagement part 163 of the lock member 16 has continuous V-shaped (or serrated) grooves. The housing 21 of the motion mechanism 20 has a rear face 21R. The rear face has continuous V-shaped (or serrated) grooves similar to those of the engagement part 163 at the position opposed to the engagement part 163. As shown in FIG. 3, a coil spring 18 is mounted and this coil spring biases the lock member 16 counterclockwise in a side view of the printer 1 from the left to the right. With this configuration, when a user does not manipulate the tab 161, the engagement part 163 of the lock member 16 and the engagement part 211 of the housing 21 engage as shown in FIG. 4A to limit the movement of the guides 12L, 12R in the transverse direction.

FIG. 4B shows a state (the same state as in FIG. 3) in which engagement between the housing 21 of the motion mechanism 20 and the lock member 16 is cancelled. To cancel the engagement of the housing 21 with the lock member 16 in FIG. 4A, a user moves the tab 161 of the lock member 16 rearward against the biasing force of the coil spring 18. Then, the lock member 16 rotates clockwise in a side view from the left to the right of the printer 1 to cancel the engagement between the engagement part 163 of the lock member 16 and the engagement part 211 of the housing 21. When the tab 161 moves rearward, the rack-and-pinion of the motion mechanism 20 can act, so that the motion of the guides 12L, 12R in the transverse direction is not limited. Then a user can adjust the guides 12L and 12R to desired positions in the width direction of the paper roll R in accordance with the width of the paper roll R to be contained in the container 8.

After setting the guides 12L, 12R at desired positions, the user stops the manipulation of the tab 161. Then the engagement part 163 of the lock member 16 and the engagement part 211 of the housing 21 engage again due to the biasing force of the coil spring 18 so as to limit the movement of the guide 12L in the transverse direction.

Referring next to FIG. 5, the following describes the roll holders 14L, 14R. FIG. 5 shows the roll holder 14R, and the roll holder 14L has a similar shape.

The roll holders 14L and 14R have holding parts 1432L and 1432R, respectively, to hold the paper roll R, and the following refers to them simply as a holding part 1432 to describe their common features as needed.

Referring to FIG. 5, the roll holder 14R includes a plate-shaped body 141, a shaft 142, a swing member 143, a torsion spring 144 and a displacement part 145. The plate-shaped body 141 has a rectangular shape as a whole.

The swing member 143 includes tubular parts 1431 at one end (two positions), the holding part 1432 at the other end, and a body 1433 to join the tubular parts 1431 and the holding part 1432. The swing member 143 swings about a swing axis 143C. As the swing member 143 swings, the holding part 1432 can swing between a protruding position where the holding part protrudes inwardly from the abutting face 12*s* of the guide 12R and a non-protruding position where the holding part does not protrude inwardly from the abutting face 12*s*. At the protruding position, the holding part holds the paper roll R rotatably.

The protruding position and the non-protruding position are examples of a first position and a second position, respectively.

In the example of FIG. 5, the swing member 143 and the displacement part 145 are formed integrally. That is, the displacement part 145 is integral with the holding part 1432 so as to extend upward from the holding part 1432 (i.e., toward the opening 8*b*). The displacement part 145 has an extension 1451 extending upward from the holding part 1432 and an end 1452 at the top of the extension 1451.

The displacement part 145 is displaced with the swinging of the swing member 143. The displacement part 145 allows a user to recognize or perceive a change in position of the holding part 1432 due to the swinging of the swing member 143, through the opening 8*b* of the container 8.

The plate-shaped body 141 has an opening 1410B at a lower part. The shaft 142 and the torsion spring 144 are mounted at the opening 1410B. The shaft 142 is inserted into the hollow of each tubular part 1431 of the swing member 143, so that the holding part 1432 of the swing member 143 can swing about the shaft 142 (i.e., about the swing axis 143C).

The torsion spring 144 biases the swing member 143 in the rotating direction d1 in FIG. 5 about the swing axis 143C, and so biases the holding part 1432 of the swing member 143 in the direction from the non-protruding position to the protruding position.

While being biased by the torsion spring 144, the swing member 143 is in contact with a stopper 1410C at the body 1433. When the body 1433 is in contact with the stopper 1410C, the holding part 1432 of the swing member 143 protrudes through an opening 1410A of the plate-shaped body 141 inwardly from the abutting face 12*s* of the guide 12L to abut on the paper roll R. When the roll R is inserted into the container 8 to be held by the roll holding mechanism 10, the outer circumferential face and the side faces Rs of the paper roll R come into contact with the holding part 1432. Thereby the holding part 1432 swings in the rotating direction d2 in FIG. 5 against the biasing force of the torsion spring 144. As a result, the holding part 1432 swings to the non-protruding position where the holding part does not protrude inwardly from the abutting face 12*s*.

Preferably, the holding part has an inclined face 151 that is inclined relative to the side face Rs of the paper roll R that is being held. The inclined face 151 is inclined inwardly and forward of the printer 1. In other words, the inclined face 151 is inclined along the insertion direction so as to be directing toward the inside of the virtual center axis of the inserted paper roll R. Thereby, when a user opens the cover 3 to store the roll R into the container 8, it is easier for the user to bring the paper roll R into contact with the inclined face 151. By moving the paper roll R downward (insertion direction) while it is in contact with the inclined face 151, the user can swing the end 1452 from the protruding position to the non-protruding position smoothly against the biasing force of the torsion spring 144. That is, with the inclined face 151, the user can swing the holding part 1432 in the rotating direction d2 smoothly, when inserting the paper roll R into the container 8.

The rectangular plate-shaped body 141 has attachments 1412, 1414, a concave 1416, and a groove 1417 at the long sides. They are parts to attach the roll holder 14R to the guide 12R.

Attachment of the roll holder 14R to the guide 12R will be described later.

Referring next to FIG. 6, the following describes the guides 12L, 12R. FIG. 6 shows a major part of the guide 12R, and a corresponding part of the guide 12L also has a similar shape although not shown.

Referring to FIG. 6, the guide 12R has a substantially rectangular opening 120 to receive the rectangular roll holder 14R. A part surrounding the opening 120 has thin-wall parts 122, 124 that are thinner than the other part. The thin-wall parts are to attach the attachments 1412, 1414 of the roll holder 14R.

The part surrounding the opening 120 has first convexes 126 (two places) and second convexes 127 (two places), and these convexes protrude inwardly.

The guide 12R has an insertion part 125 at the top. The engagement part is a U-shaped groove. The insertion part 125 is inserted by the end 1452 of the displacement part 145 when the holding part 1432 is at the protruding position.

Referring next to FIGS. 7 and 8, the following describes the guide 12R attached to the roll holder 14R. FIG. 7 is a partial left side view of the roll holding mechanism 10 according to the present embodiment. FIG. 8 is a partial right side view of the roll holding mechanism 10 according to the present embodiment.

As shown in FIGS. 7 and 8, when the roll holder 14R is attached to the guide 12R, the first convexes 126 engage with the concaves 1416 (see FIG. 5) of the roll holder 14R and the second convexes 127 engage with the groove 1417 (see FIG. 5) of the roll holder 14R.

When the roll holder 14R is attached to the guide 12R, an attachment claw 1412B of the roll holder 14R engages the thin-wall part 124 on one face, and attachment claws 1412C (two places) of the roll holder 14R engage with the thin-wall part 124 on the other face. Then an attachment claw 1414B of the roll holder 14R engages the thin-wall part 122 on one face, and attachment claws 1414C (two places) of the roll holder 14R engage with the thin-wall part 122 on the other face. That is, the attachment claws 1412B, 1412C sandwich the thin-wall part 124 from both sides, and the attachment claws 1414B, 1414C sandwich the thin-wall part 122 from both sides.

Note here that flexible arms 1412A, 1414A bend so that these claws can separate from the thin-wall parts 122, 124. In this way, the roll holders 14L and 14R can be attached to and detached from the guides 12L and 12R, respectively.

Referring to FIG. 7, similarly to the abutting face 12*s* of the guide 12R, the surface 141*s* of the plate-shaped body 141 faces the side face Rs of the paper roll R. Preferably, the abutting face 12*s* of the guide 12R and the surface 141*s* of the plate-shaped body 141 are flush with each other. When they are flush with each other, the roll holder can hold the paper roll R efficiently from the early phase in which the outer diameter of the paper roll R is larger, to the later phase in which the outer diameter of the paper roll R is smaller.

(3) Operation of Roll Holding Mechanism 10

Figure 9B:
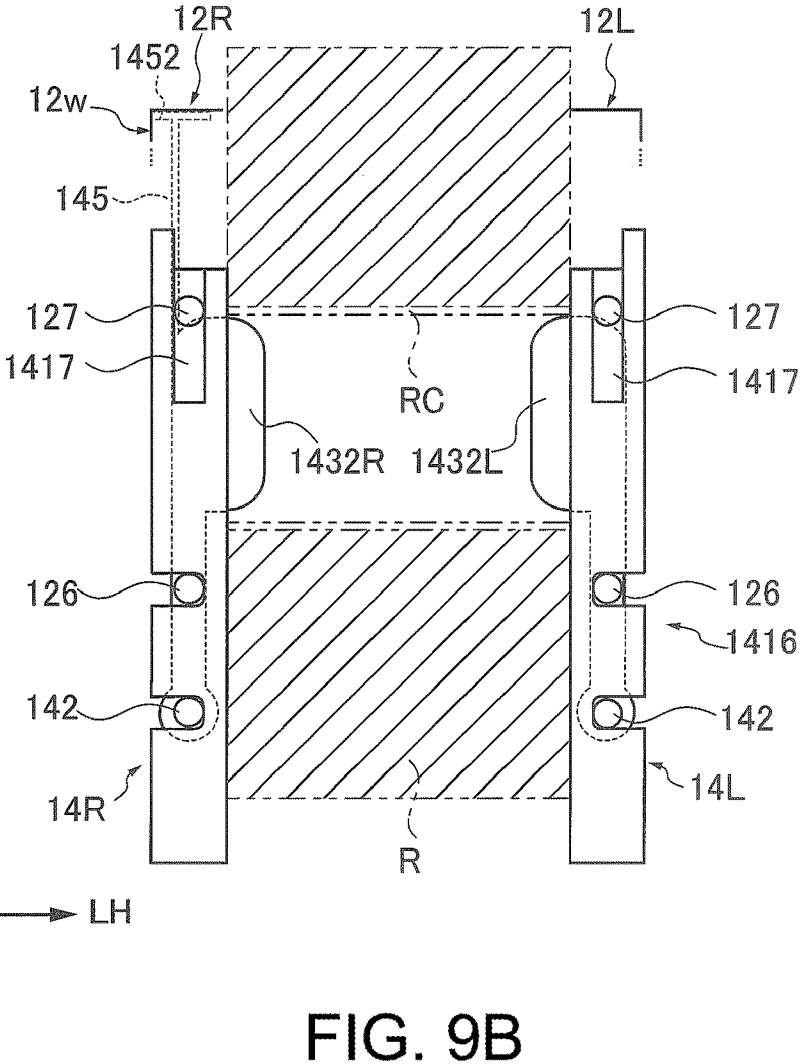
FIG. 9B is a schematic front view of the roll holding mechanism when the roll holding mechanism holds a paper roll.
Figure 9A:
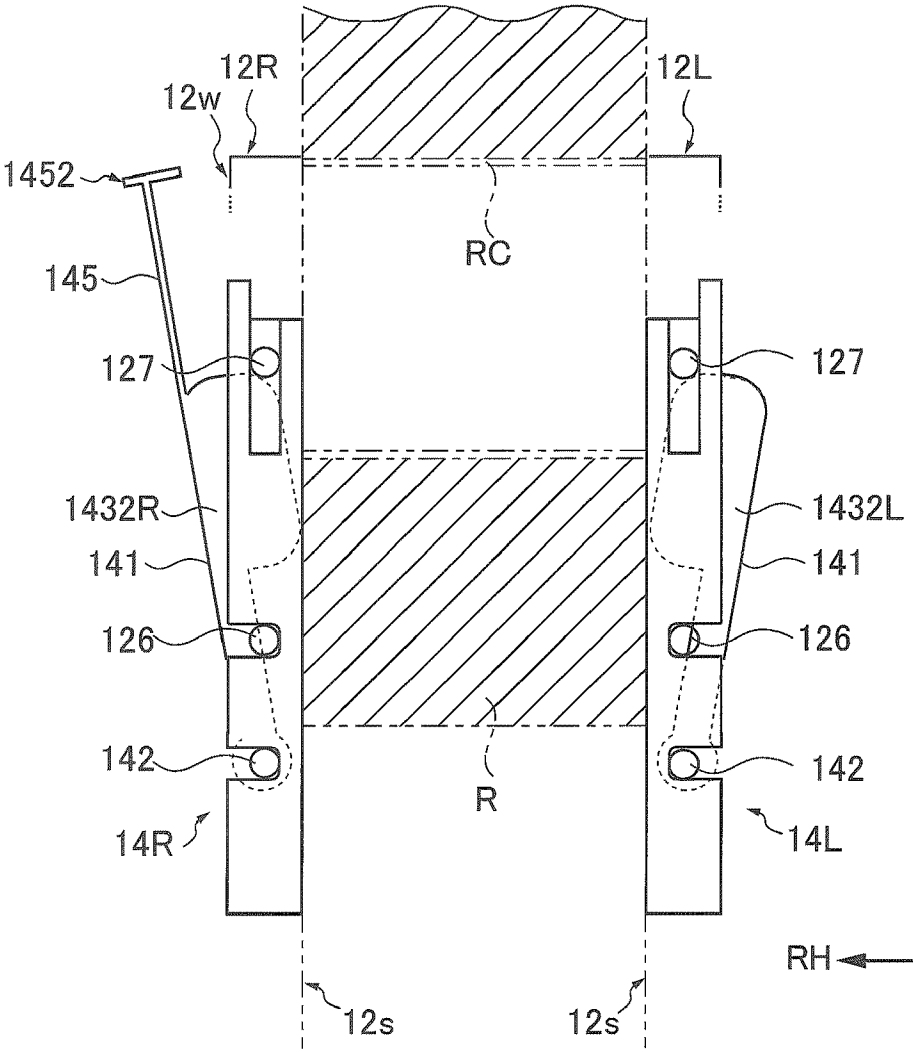
FIG. 9A is a schematic front view of the roll holding mechanism according to one embodiment when the roll holding mechanism does not hold a paper roll.
Figure 10A:
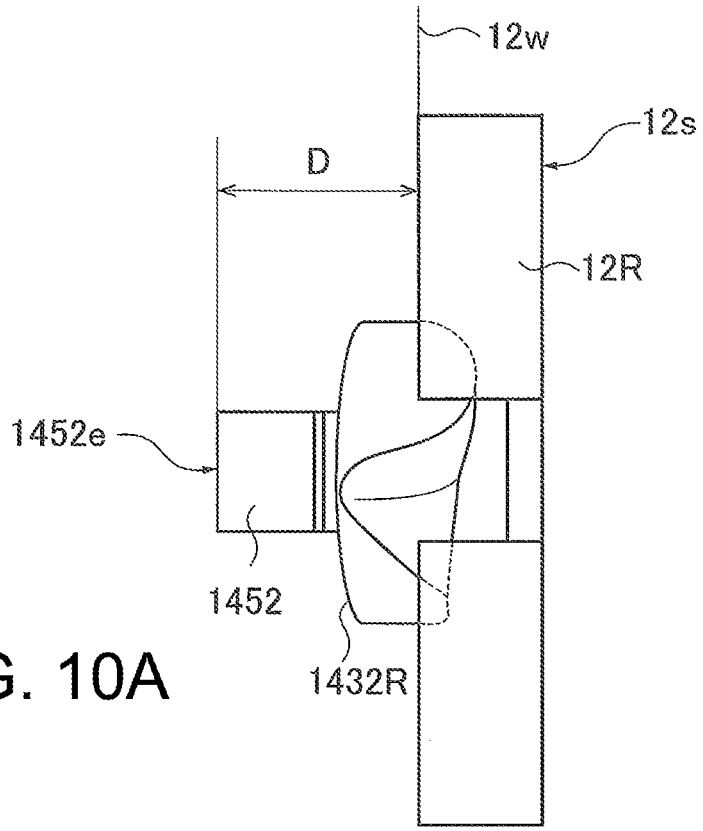
FIG. 10A shows the position of the end of the displacement part when the roll holding mechanism according to one embodiment does not hold a paper roll.
Figure 10B:
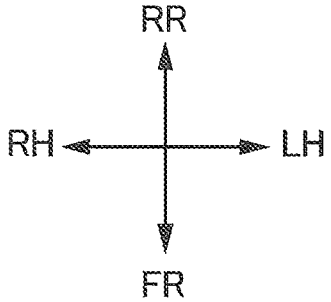
FIG. 10B shows the position of the end of the displacement part when the roll holding mechanism holds a paper roll.
Figure 10B:
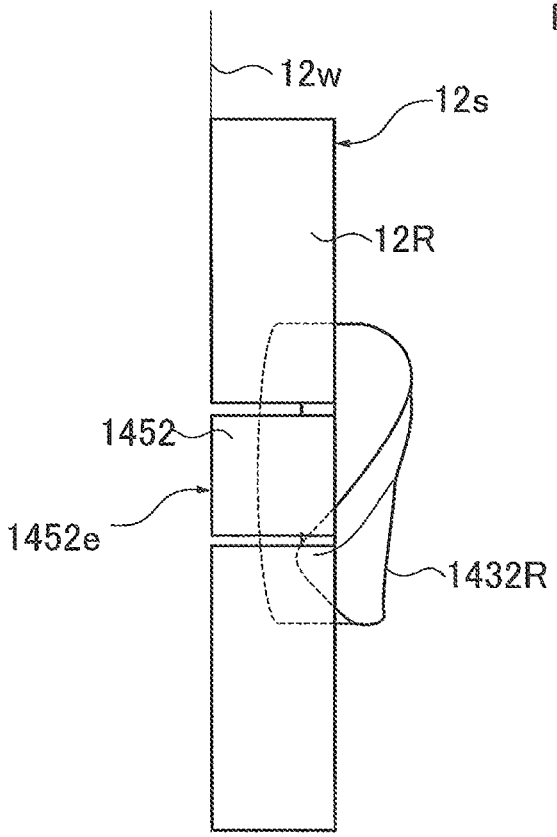

Referring next to FIGS. 9 and 10, the following describes the operation of the roll holding mechanism 10.

FIG. 9A is a schematic front view of the roll holding mechanism 10 when the roll holding mechanism 10 does not hold a paper roll R. FIG. 9B is a schematic front view of the roll holding mechanism 10 when the roll holding mechanism 10 holds a paper roll R. FIG. 10A shows the position of the end 1452 of the displacement part 145 when the roll holding mechanism 10 does not hold a paper roll R. FIG. 10B shows the position of the end 1452 of the displacement part 145 when the roll holding mechanism 10 holds a paper roll R.

The following describes the operation of the roll holding mechanism 10 during insertion of a paper roll. FIGS. 9A and 9B assume the case where a user has already moved the pair of guides 12L and 12R for adjustment in the transverse direction before insertion of the paper roll R so that the distance between the pair of guides 12L and 12R agrees with the width of the paper roll R. These drawings show the virtual lines of the abutting faces 12*s* of the guides 12L and 12R, assuming that the abutting faces are flush with the surface 141*s* of the plate-shaped body 141.

When inserting a paper roll R into the container 8 of the printer 1, a user inserts the paper roll R downward between the roll holders 14L and 14R (i.e., between the guides 12L and 12R) of the roll holding mechanism 10. At this time, the lowermost part of the outer circumferential face of the paper roll R comes into contact with the holding parts 1432 of the roll holders 14L and 14R. Then the downward insertion force of the paper roll R rotates the holding parts 1432 outwardly about the shaft 142, against the biasing force of the torsion spring 144 (not shown in FIG. 9B). As a result, as shown in FIGS. 9A and 10A, the holding parts 1432 swing to the non-protruding position where the holding parts do not protrude inwardly from the abutting faces 12*s* of the guides 12L and 12R.

As shown in FIGS. 9A and 10A, as the holding parts 1432 swing to the non-protruding position, the displacement part 145 is displaced so that the end 1452 of the displacement part 145 is located outside of the rear face 12*w* of the guide 12R.

When the paper roll R is moved further downward until the hollow part of the paper core RC of the paper roll R reaches the same height as the holding parts 1432, the holding parts 1432 swing inwardly due to the biasing force of the torsion spring 144. As a result, at the hollow part of the paper core RC of the paper roll R, the holding parts 1432 swing from the abutting faces 12*s* of the guides 12L and 12R to the protruding position where the holding parts protrude inwardly. As a result, the roll holders 14L and 14R hold the paper roll R as shown in FIG. 9B.

As shown in FIGS. 9B and 10B, as the holding parts 1432 swing from the non-protruding position to the protruding position, the displacement part 145 is also displaced so that the end 1452 of the displacement part 145 is located inside of the rear face 12*w* of the guide 12R.

As described above, in the roll holding mechanism 10 of the present embodiment, a position of the end 1452 of the displacement part 145 varies depending on whether the holding part 1432 is at the protruding position or at the non-protruding position. As shown in FIG. 9B, when the holding parts 1432 hold the paper roll R, the holding parts 1432 are inserted into the inside of the paper core RC. In this case, it is difficult for a user to directly visually check the holding parts 1432, through the opening 8*b* of the printer 1, to see whether holding parts 1432 has reliably held the paper roll R or not. In this respect, the roll holding mechanism 10 of the present embodiment is configured so that the end 1452 of the displacement part 145 is always exposed through the opening 8*b* of the printer 1, irrespective of whether the holding parts 1432 is at the non-protruding position or at the protruding position. Therefore, the user can recognize whether the holding parts 1432 has reliably held the paper roll R or not by visually checking, through the opening 8*b*, the position of the end 1452 of the displacement part 145, which is displaced with the holding parts 1432.

In a preferable example of the present embodiment, the end face 1452*e* of the end 1452 of the displacement part 145 and the rear face 12*w* of the guide 12R are flush with each other when the holding parts 1432 are at the protruding position (FIG. 10B). When the holding parts 1432 are at the non-protruding position (FIG. 10A), these faces are not flush with each other. With the end face 1452*e* shaped this way, the accuracy can increase to visually check by the user whether the holding parts 1432 has reliably held the paper roll R or not.

The above embodiment describes the case where the holding part 1432 swings about the swing axis 143C that is disposed close to the inner bottom face 8*a* at the guide 12R, and the end 1452 of the displacement part 145 close to the opening 8*b* is the swing end of the swinging of the holding part 1432. The displacement amount of the end 1452 of the displacement part 145 is recognized by a user as a guide whether the paper roll R is held or not. The above embodiment has an advantageous effect that the displacement amount of the end 1452 becomes larger and easily visually checked by a user. Instead of disposing the swing axis close to the inner bottom face 8*a*, which is not essential, the swing axis may be at any position between the upper and the lower of the printer.

That is detailed descriptions on one embodiment of the present invention. The printer of the present invention is not limited to the above embodiment, and the embodiment may be modified or changed variously without departing from the scope of the present invention.

Figure 11A:
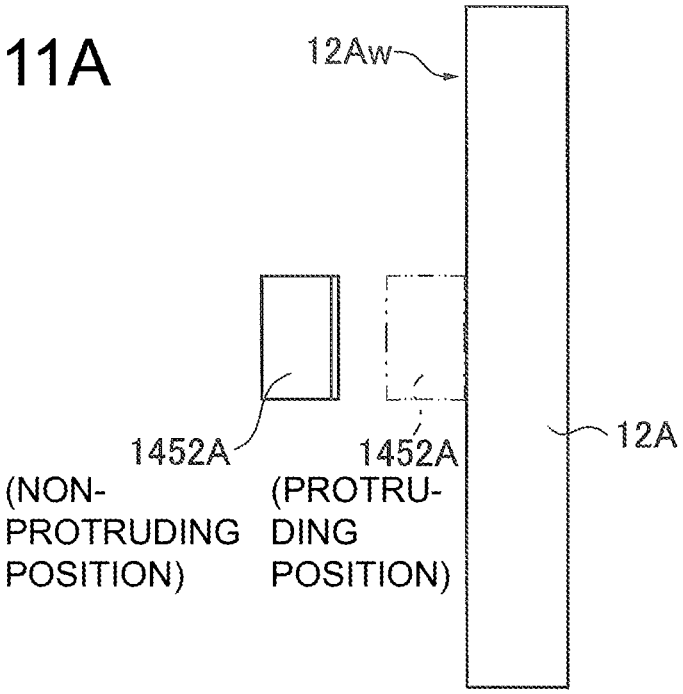
FIGS. 11A and 11B describe modified examples of the displacement part.
Figure 11A:
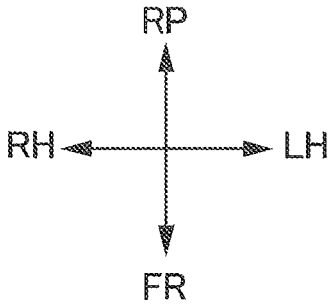
Figure 11B:
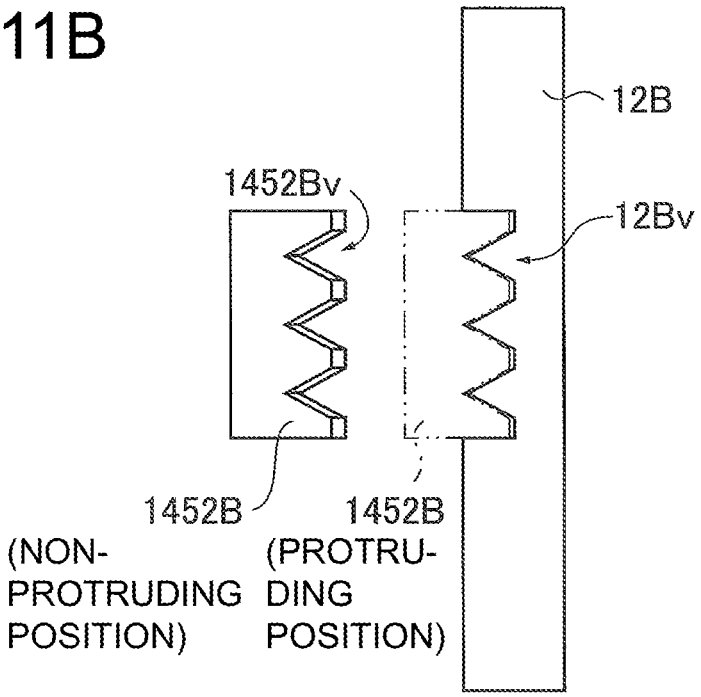

Referring to FIGS. 11A and 11B, the following describes a modified example of the displacement part in the above embodiment. FIGS. 11A and 11B describe modified examples of the displacement part. These drawings, which are plan views similarly to FIGS. 10A and 10B, show the end of the displacement part and the guide only.

The above embodiment shows one example of the displacement part 145 enabling the perception of a positional relationship of the end 1452R relative to the referential face of the guide 12R, and the following describes other examples.

For instance, in a modified example of FIG. 11A, the end 1452A of the displacement part is configured as follows. Specifically, the end 1452A comes in contact with the rear face 12Aw of the guide 12A or is the closest to the rear face 12Aw, when the holding part 1432 is at the protruding position. The end 1452A does not come in contact with the rear face 12Aw of the guide 12A or is the farthest from the rear face 12Aw, when the holding part 1432 is at the non-protruding position.

In another example, the displacement part may be configured so that the end of the displacement part engages with the guide when the holding part 1432R is at the protruding position and the end of the displacement part does not engage with the guide when the holding part 1432 is at the non-protruding position. In this case as well, the user can visually check whether the holding part 1432 has reliably held the paper roll R or not, based on whether the displacement part and the guide engage or not.

In a modified example in FIG. 11B, for example, the end 1452B of the displacement part is configured so that the end 1452B engages with an engagement part 12Bv of the guide 12B when the holding part 1432 is at the protruding position, and the end 1452B does not engage with the engagement part 12Bv of the guide 12B when the holding part 1432 is at the non-protruding position.

The above embodiment describes the case where the displacement part 145 is integral with the holding part 1432R so as to extend from the holding part 1432R toward the opening 8*b*. In another example, the displacement part 145 does not have to be integral with the holding part 1432R as long as the displacement part is displaced with the motion of the holding part 1432R. For instance, a predetermined joint mechanism, such as a gear, may be disposed between the displacement part 145 and the holding part 1432R.

As shown in FIG. 9, the above embodiment describes the case where the holding part 1432R (one example of a second portion) on the right only includes the displacement part 145, while the holding part 1432L (one example of a first portion) on the left does not include the displacement part 145. In another example, each of the holding parts 1432L and 1432R may have the displacement part. Such displacement parts at both of the holding parts allow a user to visually check whether the paper roll R is reliably held by the left and right holding parts 1432L and 1432R. This can increase the reliability of checking whether the paper roll R is held or not.

The above embodiment describes the case where the holding parts 1432 swing between the protruding position and the non-protruding position. In another example, the holding parts 1432 may move in a translational manner between the protruding position and the non-protruding position. For such an example of the holding parts moving in a translation manner, see Japanese Patent Application Laid-open 2016-124205 (the second guide member 62 corresponds to the holding part).

The above embodiment describes the roll holding mechanism 10 including the motion mechanism 20. In another example, when the paper roll R to be contained in the container 8 has a constant width, there is no need to move the guides 12L, 12R in the width direction of the paper roll R. The motion mechanism 20 is then not necessary. In this case, the guide does not have to include the referential face (in the above embodiment, the rear face 12*w* of the guide 12R) for allowing a user to perceive a relative positional relationship of the end 1452R of the displacement part 145. For instance, the referential face may be disposed at the inner wall face of the housing 2.

The above example describes the continuous sheet P including a belt-shaped liner PM and a plurality of labels PL that are temporally attached on the liner at predetermined intervals as an example of the paper roll R held by the roll holding mechanism 10. In another embodiment, any type of the paper roll R may be applied. A roll into which a print paper excluding an adhesive is wound, or a roll into which a long print paper including an adhesive on its back surface is wound, may be applied.

DESCRIPTION OF REFERENCE NUMERALS

1 printer
2 housing
3 cover
31 shaft
4 display panel
5 platen roller
6 thermal head
7 ejection port
8 container
8*a* inner bottom face
8*b* opening
10 roll holding mechanism
12L,12R guide
12*s* abutting face
12*w* rear face
120 opening
122, 124 thin-wall part
125 insertion part
126 first convex
127 second convex
14L, 14R roll holder
141 plate-shaped body

141*s* surface
1410A, 1410B opening
1410C stopper
1412 attachment
1412A flexible arm
1412B, 1412C attachment claw
1414 Attachment
1414A flexible arm
1414B, 1414C attachment claw
1416 concave
1417 groove
1418 notch
142 shaft
143 swing member
143C swing axis
1431 tubular part
1432 (1432L, 1432R) holding part
1433 body
144 torsion spring
145 displacement part
1451 extension
1452 end
1452*e* end face
151 inclined face
16 lock member
161 tab
162 shaft
163 engagement part
18 coil spring
20 motion mechanism
21 housing
21R rear face
211 engagement part
22L, 22R rack
220L, 220R fastener
24 pinion
R paper roll
Rs side face of paper roll
RC paper core
P continuous sheet
PM liner
PL label

The invention claimed is:

1. A printer, comprising:

a housing configured to contain a roll in which a belt-shaped print medium is wound, the roll being insertable through an opening of the housing;

first and second guides configured to guide the roll, the first and second guides being disposed in the housing, wherein the first guide has a first abutting face, and the second guide has a second abutting face, wherein the first and second abutting faces face each other in a thickness direction and are configured to abut opposite side faces of the roll;

a first holding part that is attached to the first guide, the first holding part being swingable about a swing axis between a first position in which the first holding part protrudes inwardly from the first abutting face and a second position in which the first holding part does not protrude inwardly from the first abutting face, the first holding part being configured to hold the roll rotatably at the first position;

a displacement part configured to be displaced with motion of the first holding part; and a spring configured to bias the first holding part from the second position to the first position, the spring being structured so as to be structurally separated from the first holding part, wherein a groove is formed at a top of the first guide and penetrates entirely through the first guide in the thickness direction, wherein the displacement part has an end close to the opening, and wherein the end of the displacement part is exposed through the opening such that it is visually recognizable through the opening such that:

the end of the displacement part is located in the groove of the first guide when the first holding part is at the first position, and the end of the displacement part is located outside of the groove of the first guide when the first holding part is at the second position.

2. The printer according to claim 1, wherein one face of the end of the displacement part is flush with a predetermined referential face of the first guide when the first holding part is at the first position, and is not flush with the referential face of the first guide when the first holding part is at the second position.

3. The printer according to claim 2, wherein the housing has a bottom face opposed to the opening, the swing axis is provided close to the bottom face at the first guide, and the end of the displacement part is a swing end when the first holding part swings.

4. The printer according to claim 2, wherein the displacement part is integral with the first holding part so as to extend from the first holding part to the opening.

5. The printer according to claim 2, wherein

The first holding part has a first portion, and the second holding part has a second portion, the first portion corresponding to the first abutting face, the second portion corresponding to the second abutting face, and the displacement part is disposed at each of the first portion and the second portion.

6. The printer according to claim 2, wherein the first holding part has an inclined face, the inclined face being configured such that, when the roll is inserted into the housing, the first holding part is configured to move from the first position to the second position with movement of the roll in an insertion direction after coming in contact with the first holding part.

7. The printer according to claim 1, wherein the housing has a bottom face opposed to the opening, the swing axis is provided close to the bottom face at the first guide, and the end of the displacement part is a swing end when the first holding part swings.

8. The printer according to claim 7, wherein the displacement part is integral with the first holding part so as to extend from the first holding part to the opening.

9. The printer according to claim 7, wherein the first holding part has a first portion, and the second holding part has a second portion, the first portion corresponding to the first abutting face, the second portion corresponding to the second abutting face, and the displacement part is disposed at each of the first portion and the second portion.

10. The printer according to claim 7, wherein the first holding part has an inclined face, the inclined face being configured such that, when the roll is inserted into the housing, the first holding part is configured to move from the first position to the second position with movement of the roll in an insertion direction after coming in contact with the first holding part.

11. The printer according to claim 1, wherein the displacement part is integral with the first holding part so as to extend from the first holding part to the opening.

12. The printer according to claim 11, wherein the first holding part has a first portion and the second holding part has a second portion, the first portion corresponding to the first abutting face, the second portion corresponding to the second abutting face, and the displacement part is disposed at each of the first portion and the second portion.

13. The printer according to claim 11, wherein the first holding part has an inclined face, the inclined face being configured such that, when the roll is inserted into the housing, the first holding part is configured to move from the first position to the second position with movement of the roll in an insertion direction after coming in contact with the first holding part.

14. The printer according to claim 1, wherein the first holding part has a first portion, and the second holding part has a second portion, the first portion corresponding to the first abutting face, the second portion corresponding to the second abutting face, and the displacement part is disposed at each of the first portion and the second portion.

15. The printer according to claim 14, wherein the first holding part has an inclined face, the inclined face being configured such that, when the roll is inserted into the housing, the first holding part is configured to move from the first position to the second position with movement of the roll in an insertion direction after coming in contact with the first holding part.

16. The printer according to claim 1, wherein the first holding part has an inclined face, the inclined face being configured such that, when the roll is inserted into the housing, the first holding part is configured to move from the first position to the second position with movement of the roll in an insertion direction after coming in contact with the first holding part.

17. The printer according to claim 1, wherein the groove is U-shaped.

* * * * *